US006599016B1

(12) United States Patent
Culbertson et al.

(10) Patent No.: US 6,599,016 B1
(45) Date of Patent: Jul. 29, 2003

(54) PINCH BOTTOM BAG WITH TEAR STRIP

(75) Inventors: Edward D. Culbertson, Kearney, MO (US); George Bradley Griffin, Beebe, AR (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/075,154

(22) Filed: Feb. 14, 2002

(51) Int. Cl.[7] ..... B65D 30/08

(52) U.S. Cl. ..... 383/206; 383/88; 383/114; 383/906; 493/212

(58) Field of Search ..... 383/206, 205, 383/88, 114, 115, 906; 493/212

(56) References Cited

U.S. PATENT DOCUMENTS

| | | | | |
|---|---|---|---|---|
| 1,682,839 A | | 9/1928 | Finn et al. | |
| 2,560,535 A | | 7/1951 | Allen | 229/76 |
| 2,772,823 A | | 12/1956 | Plamann | 222/527 |
| 2,810,509 A | | 10/1957 | Gelbcke | 229/55 |
| 2,870,955 A | | 1/1959 | Brady et al. | 229/66 |
| 2,956,724 A | | 10/1960 | Owens | 229/66 |
| 3,083,876 A | | 4/1963 | Schneider et al. | 222/107 |
| 3,101,887 A | | 8/1963 | Kugler | 229/62 |
| 3,227,359 A | | 1/1966 | Hanlon | 229/66 |
| 3,272,424 A | | 9/1966 | Rodkey | 229/66 |
| 3,397,835 A | | 8/1968 | Henning | 229/66 |
| 3,399,760 A | | 9/1968 | Heckler, IV | 206/65 |
| 3,482,758 A | | 12/1969 | Pierre et al. | 229/14 |
| 3,508,701 A | | 4/1970 | Saito | 229/53 |
| 3,554,437 A | | 1/1971 | Kimsey | 229/66 |
| 3,565,328 A | | 2/1971 | Hudson | 229/55 |
| 3,570,751 A | | 3/1971 | Trewella | 229/66 |
| 3,807,626 A | * | 4/1974 | Goodrich | 383/85 |
| 3,850,366 A | * | 11/1974 | Saito | 383/206 |
| 3,910,488 A | * | 10/1975 | Goodrich | 383/85 |
| 3,958,749 A | * | 5/1976 | Goodrich | 383/206 |
| 3,973,045 A | * | 8/1976 | Brandberg et al. | 426/110 |
| 4,008,850 A | | 2/1977 | Goodrich | 229/55 |
| 4,069,964 A | | 1/1978 | Willet et al. | 229/62.5 |
| 4,088,264 A | | 5/1978 | Vogt | 229/55 |
| 4,142,667 A | | 3/1979 | Runo | 229/62.5 |
| 4,441,613 A | | 4/1984 | Hain et al. | 206/621 |
| 4,450,581 A | | 5/1984 | Hirata | 383/42 |
| 4,471,875 A | | 9/1984 | Hain et al. | 206/632 |
| 4,480,752 A | | 11/1984 | Jacobs | 206/632 |
| 4,483,445 A | | 11/1984 | Lepisto et al. | 206/621 |
| 4,512,479 A | | 4/1985 | Hain et al. | 206/632 |
| 4,515,273 A | | 5/1985 | Jacobson et al. | 206/604 |
| 4,557,385 A | | 12/1985 | Robinson | 206/620 |
| 4,567,987 A | | 2/1986 | Lepisto et al. | 206/616 |
| 4,610,357 A | | 9/1986 | Nakamura | 206/449 |
| 4,739,879 A | | 4/1988 | Nakamura | 206/205 |
| 4,768,654 A | | 9/1988 | Jacobs | 206/626 |
| 4,913,293 A | | 4/1990 | Sanders | 206/620 |
| 4,974,732 A | | 12/1990 | Sullivan et al. | 206/610 |
| 5,018,625 A | | 5/1991 | Focke et al. | 206/621 |
| 5,054,619 A | | 10/1991 | Muckenfuhs | 206/610 |
| 5,060,803 A | | 10/1991 | Beer et al. | 206/610 |
| 5,114,243 A | | 5/1992 | Their | 383/85 |
| 5,158,499 A | | 10/1992 | Guckenberger | 206/524.2 |
| 5,281,027 A | | 1/1994 | Thrall | 383/88 |
| 5,312,189 A | | 5/1994 | Aeschbach et al. | 383/207 |
| 5,392,589 A | | 2/1995 | Buchanan | 53/412 |
| 5,443,154 A | | 8/1995 | Hustad et al. | 206/213.1 |
| 5,558,438 A | | 9/1996 | Warr | 383/10 |
| 5,593,229 A | | 1/1997 | Warr | 383/209 |
| 5,611,626 A | | 3/1997 | Warr | 383/10 |
| 5,636,925 A | | 6/1997 | Smiley | 383/6 |
| 5,655,843 A | | 8/1997 | Conrad et al. | 383/204 |
| 5,702,339 A | | 12/1997 | Smiley | 493/196 |
| 5,829,884 A | | 11/1998 | Yeager | 383/61 |

FOREIGN PATENT DOCUMENTS

| | | | |
|---|---|---|---|
| EP | 28 42 936 | 4/1980 | 5/70 |
| EP | 0 109 965 | 11/1982 | 75/36 |
| EP | 0 368 145 | 11/1989 | |
| EP | 0 553 413 A1 | 11/1992 | 75/58 |
| EP | 0 553 413 B1 | 11/1992 | 75/58 |
| EP | 0 577 989 A1 | 6/1993 | 5/70 |
| EP | 0 596 747 A1 | 11/1993 | 75/58 |
| GB | 2 150 908 | 7/1985 | |
| NL | 7015601 | 4/1972 | |
| NL | 8301946 | 1/1985 | 77/12 |
| WO | WO 93/16929 | 9/1993 | 30/18 |

* cited by examiner

*Primary Examiner*—Stephen P. Garbe
(74) *Attorney, Agent, or Firm*—Greenberg Traurig, P.C.

(57) ABSTRACT

A pinch bottom bag construction, for a multiwall bag, incorporating an easy open feature, which permits the controlled opening of a portion of the mouth opening of the bag, to create a spout-like opening, with the use of a tear strip disposed on the upper step of the manufacturer's opening.

7 Claims, 6 Drawing Sheets

PINCH BOTTOM BAG WITH TEAR STRIP

BACKGROUND OF THE INVENTION

1. The Technical Field

The present invention relates in general to multiwall pinch bottom bags, of the type, which are typically fabricated as a tube formed from one or more paper plies.

2. The Prior Art

Multiwall bags, fabricated as tubes formed from a plurality of paper plies, are known. Typically, the ends of the tubes are cut, so that when the end or ends of the bag are flattened, the plies of the bag, on both sides of the mouth opening of the bag, are provided with steps. The stepped-end cut pattern creates a closure flap on one side (the "high" side) of the mouth opening of the bag. The side of the bag on the opposite side of the mouth opening is the "short" side. Closure of the bag is typically accomplished by applying adhesive (e.g., hot melt or sonically activatable adhesive) to the outer surface of the short side of the bag. In addition to, or alternative to, providing adhesive on the face of the bag, adhesive may be applied to the inside surface of the closure flap. When the closure flap is folded over the mouth opening of the bag, preferably, the stepped plies of the flap substantially align with and overlie correspondingly cut steps in the bag plies on the face of the bag on the short side of the mouth opening.

Closing the bag by simply folding and adhesively affixing the flap provides the pointed, pinch bottom closure. The opposite end of the bag may be likewise provided with a pinch bottom closure, or it may be closed and sealed in a different configuration, such as a diamond- or rectangular configuration, so that the pinch "bottom" may actually be the top of the bag, as may be found commonly in bags containing dry granular material, like dog food or cat litter.

In addition to having paper plies, one or more plies, typically the innermost one or more plies, may be fabricated from a thin plastic material, or may be coated with a resinous material, to provide a degree of moisture resistance to the finished bag.

While the bag may be formed initially as a simple flattened tube, with folded closure flaps, pinch bottom bags are also known, in which typically both sides of the bag are gusseted, so that there are inward V-folds at each side of the bag, prior to folding the closure flap. Often, because of the stepped-end cutting of the bag plies, in the region of the gussets, the bag material extends beyond the topmost edge of the innermost ply of bag material on the "short" side of the mouth opening, so that in folding over and affixing the closure flap, the tops of the gussets are likewise folded over and captured by the closure flap. Such a prior art gusseted pinch bottom bag is disclosed in Goodrich, U.S. Pat. No. 4,008,850.

When such a bag is closed and sealed, the folded over closure is typically quite strong, and requires cutting of the bag plies, below the folded over and sealed closure, in order to gain access to the contents of the bag.

In order to facilitate opening of such bag structures, multiwall bag structures are known that incorporate tear structures that may be formed by extended perforations, usually in parallel pairs, through one or more plies of the bag, or by providing ripcord structures that are embedded in the bag plies, that lead to pull tabs, that extend to the outer surface of the bag. Such prior art bag opening structures are disclosed in such references as EP 0 596 747 A1; Rodkey, U.S. Pat. No. 3,272,424; Allen, U.S. Pat. No. 2,560,535; Brady et al., U.S. Pat. No. 2,870,955; Vogt, U.S. Pat. No. 4,088,264; Robinson, U.S. Pat. No. 4,557,385; Jacobs, U.S. Pat. No. 4,768,654; Lepisto et al., U.S. Pat. No. 4,483,445; and Thrall, U.S. Pat. No. 5,281,027.

Whether opened by the simple expediency of a cutting or piercing implement, or whether opened through a prior art opening mechanism such as those disclosed in the aforementioned references, typically, opening of the bag either requires substantial effort and/or results in a ragged opening that may include opening the entire mouth of the bag. When the contents of such an opened bag are poured out, because the entire mouth has been opened there is little control over the contents, and undesired spilling of the contents may occur.

It would be desirable to provide a multiwall bag formed from one or more plies of bag material, of which at least the outermost ply or plies is/are formed from paper, that has an easy open feature, to enable facilitated access to the contents of the bag, without requiring the use of a cutting or piercing implement.

It would also be desirable to provide a multiwall bag, such as a pinch bottom closure bag, that is provided with a secure closure, but which is also provided with an easy open feature, which creates a controlled opening of only a portion of the mouth of the bag, for controlled dispensing of the contents of the bag.

These and other desirable features of the present invention will become apparent in light of the present description, claims and drawings.

SUMMARY OF THE INVENTION

The present invention is directed to a bag apparatus for the containment of material, comprising a tubular body, fabricated from at least one ply of material. The tubular body has a longitudinal axis. The tubular body also has a first end configured to form an elongated mouth opening. When in a flattened condition, the tubular body has first and second opposing sides adjacent the elongated mouth opening, and first and second side edges.

One of the opposing sides forms an upper step and the other of the opposing sides forming a lower step. A fold line extends across the tubular body, transversely to the longitudinal axis, wherein the elongated mouth and portions of the lower step are disposed longitudinally between the upper step and the fold line.

A portion of the lower step, disposed adjacent the first side edge of the tubular body, extends further longitudinally away from the fold line, than other portions of the lower step.

A tear string member is disposed transversely across the first end of the tubular body, and extends across the longitudinally extending portion of the lower step, laterally inwardly from the first side edge of the tubular body toward the second side edge of the tubular body. A line of weakness is disposed in at least one layer of the upper step of the tubular body, the line of weakness being substantially aligned with that portion of the tear string member that extends across the longitudinally extending portion of the lower step of the tubular body, and extending at least from the first side edge of the tubular body, laterally inwardly toward the second side edge of the tubular body.

In a preferred embodiment of the invention, the upper step is folded about the fold line, over and against the lower step and affixed thereto, the tear string member and the line of weakness remaining in substantially alignment, with the tear string member being in longitudinally spaced position with respect to the fold line.

In a preferred embodiment of the invention, the at least one ply of material is paper material. Preferably, the tubular body is formed from three plies of material.

In a preferred embodiment of the invention, the tubular body further comprises at least one inwardly folded gusset. The at least one inwardly folded gusset extends inwardly from the first side edge of the tubular body. In such an embodiment of the invention, the longitudinally extending portion of the lower step of the tubular body extends longitudinally beyond at least portions of the at least one inwardly folded gusset.

DETAILED DESCRIPTION OF THE INVENTION

Figure 1:
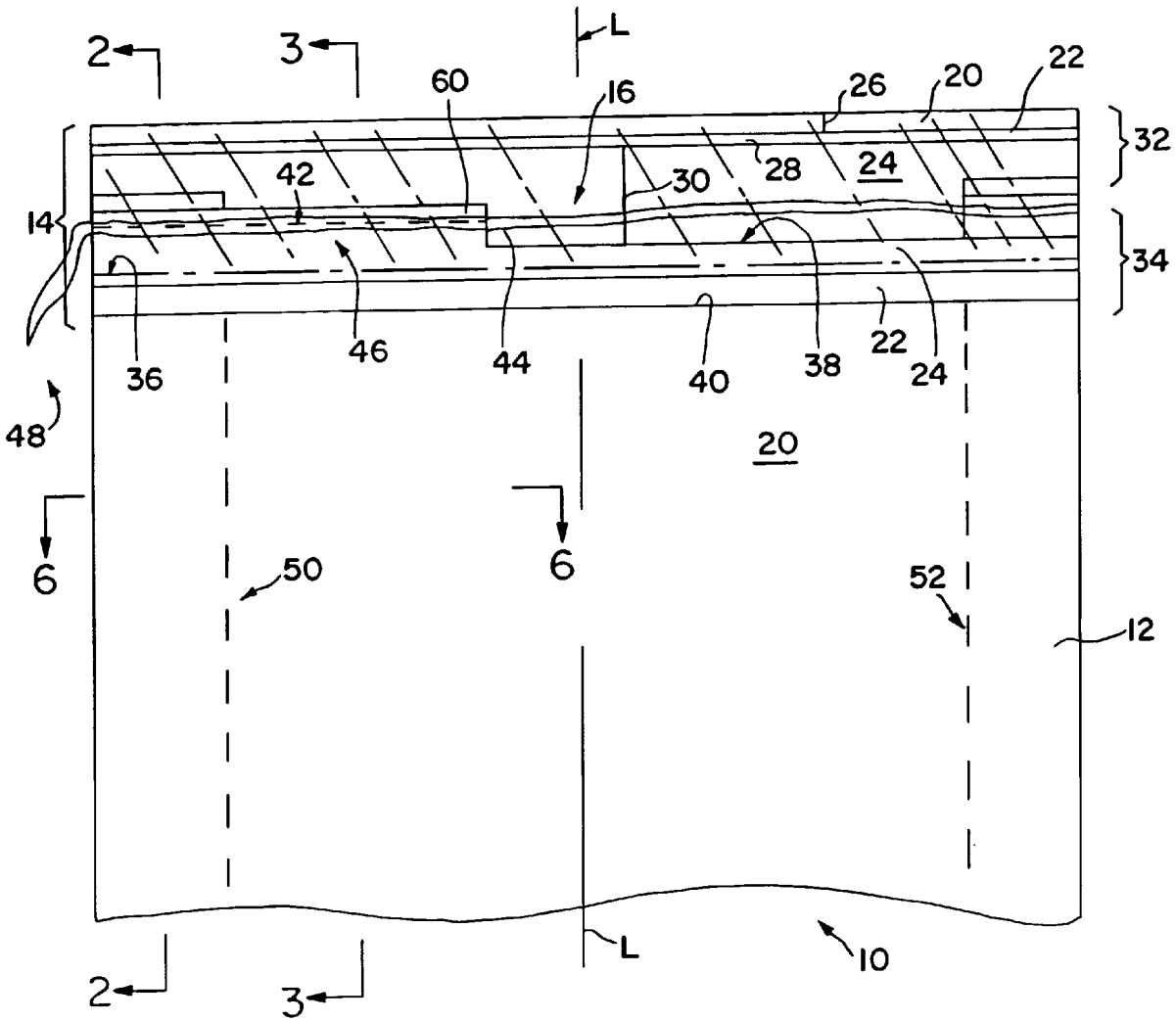
FIG. 1 is a plan view of the top end of a bag according to a preferred embodiment of the invention, with the bag end open and the tear string omitted.

While this invention is susceptible of embodiment in many different forms, there are shown in the drawings and will be described in detail herein, several specific embodiments, with the understanding that the present invention is to be considered as an exemplification of the principles of the invention and is not intended to limit to the invention to the embodiments illustrated.

Figure 2:
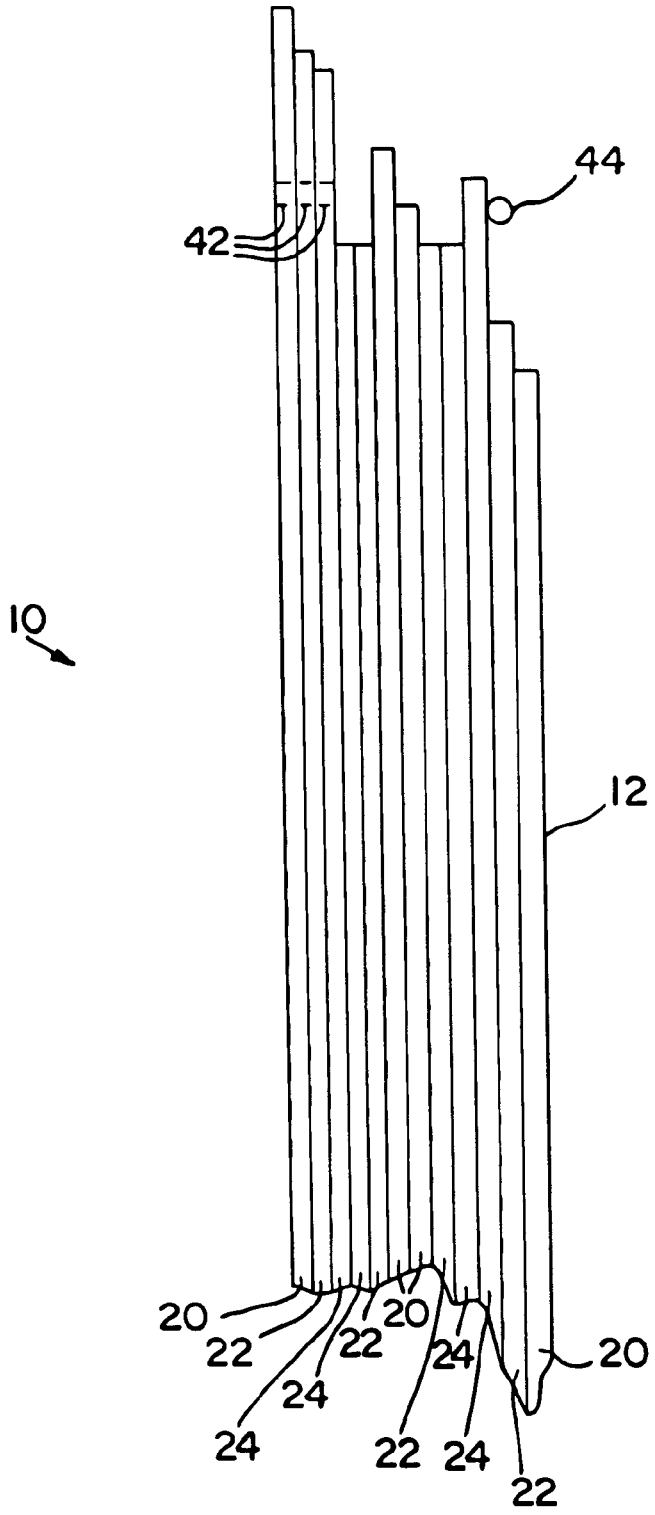
FIG. 2 is a sectional view of the top end of the bag according to FIG. 1, taken along line 2—2 of FIG. 1, in which the portions of the plies forming the left-side gusset are shown.
Figure 3:
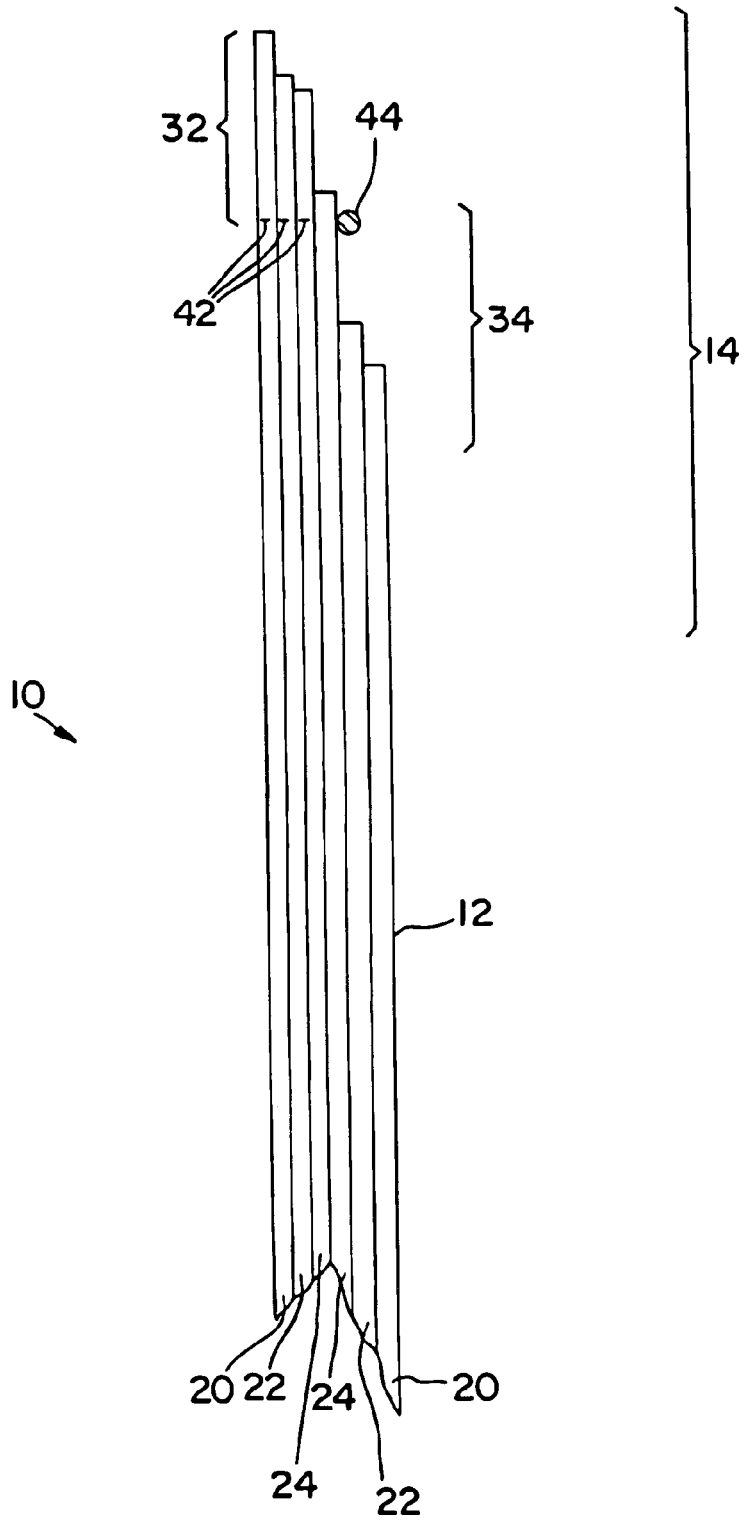
FIG. 3 is a sectional view of the top end of the bag according to FIG. 1, taken along line 3—3 of FIG. 1.

FIG. 1 is a fragmentary front elevation of one end of a pinch bottom bag, according to a preferred embodiment of the invention, in which the flap is unfolded and the mouth of the bag Bag 10 is, in a preferred embodiment of the invention, a multiwall bag having a pinch bottom type of closure structure, at least at one end. Aside from the structure of the end of the bag that is illustrated in FIGS. 1–3, in particular, the remaining structure of bag 10 may be of otherwise conventional construction. The structure that is illustrated is expected to represent, typically, the end of the bag that is opened by the consumer/ultimate customer. The other end of the bag is typically left open, when leaving the manufacturer, to permit filling of the bag by the intermediate customer (manufacturer of the goods to be bagged) and subsequent sealing.

Bag 10 is constructed as a tubular body 12 formed from a plurality of plies of material. Tubular body 12 has a longitudinal axis L. In a preferred embodiment of the invention, as shown in FIGS. 1–3 and 6, tubular body 12 is formed from three plies of material, although a greater or lesser number of plies may be used if desired or as required by the particular application. In a preferred embodiment of the invention, bag 10 has an end 14, including mouth opening 16. After tubular body 12 is formed, preferably as part of a continuous tube web from a tube forming machine (not shown), using conventional bag tube forming techniques, the elongated tube web is flattened, and the web cut into discrete tubular bodies 12. In the cutting process, the ends of each successive bag 10 are step-cut, to create an end structure and profile as illustrated.

Bag 10, as mentioned, in the embodiment of FIGS. 1–6 comprises outermost ply 20, middle ply 22 and inner ply 24. These plies are shown in FIGS. 2 and 3. In FIG. 2, the sectional view is taken through the left-side gusset as seen in FIG. 1. In a preferred embodiment, the longitudinal seams 26, 28, 30, for each of plies 20, 22, 24, respectively, are laterally staggered, so that the overlaps of each of the seams do not accumulate in thickness, so as to create a longitudinally extending ridge or bump which might adversely affect the manufacturability or handling of the bags during filling and shipping.

In the preferred embodiment of FIGS. 1–3, bag end 14 comprises an upper step 32 and a lower step 34. When bag end 14 is folded, it is folded about a transverse fold line 36. Fold line 36 may be somewhat higher or lower than the position indicated in FIG. 1, but should not be higher than the lowest edge 38 of ply 24 of lower step 34, or lower than the upper edge 40 of ply 20 of lower step 34.

To provide a facilitated opening mechanism for bag 10, after tubular body 12 has been cut and formed into a tube, a perforation 42 is formed in each of plies 20, 22 and 24, in the upper step 32 (the back side of the bag, as shown in FIGS. 1–3). No perforation is formed in either the gusset layers or in the lower step. A tear string 44 is positioned on bag end 14, as shown in FIG. 1, aligned substantially over perforation 42. Note that tear string 44 is actually laid atop portions of the plies of lower step 34. Tear string 44 is positioned upwardly (with respect to the longitudinal axis of the bag) above the top edges of the innermost plies 22, 24 of the gusset portions.

In a preferred embodiment of the invention, tear string 44 is positioned either just before or after the adhesive is applied to the upper step 32, and just prior to folding over of upper step 32. Adhesive is applied on the inside surface of upper step 32, as well as those portions of lower step 34, as indicated by the diagonal broken lines in FIG. 1, being substantially all the exposed surfaces of end 14 that are above fold line 36. Those portions of upper step 32 that are shielded by covering portions of lower step 34 that are above fold line 36, are not contacted by adhesive, so that when tear string 44 is pulled, the adjacent portions of the upper and lower steps are not stuck together, so that a pour spout opening can be formed. When upper step 32 is folded over, tear string 44 is thus positioned, as indicated, preferably about ⅜ inch below fold line 36. In particular, a raised, generally rectangular portion 60 of layer 24, which is part of the lower step 34, prevents adhesive from touching those portions of the upper step 32 that are underneath or shielded by portion 60. Referring to FIG. 1, at least innermost layer 24 of lower step 34 extends completely across tubular body 12, longitudinally above fold line 36. That means that portions of innermost layer 24 of lower step 34 are folded over and affixed to other adjacent portions of innermost layer 24 and/or intermediate layer 22 across the entire width of bag 10.

A longitudinally extended portion 36 of innermost ply 24 of lower step 34 extends longitudinally "above" tear string 44, prior to folding over of the upper step 32. This extended portion 36 of the lower step 34 permits the adjacent overlying upper step 32 layers to be released when tear string 44 is pulled, whereas, those portions of upper step 32, to the right side of tubular body 12, that are not shielded by the lower step are affixed by adhesive "above" tear string 44, when it is pulled, and preferably, will remain affixed to those portions of the lower step to which they have been adhesively affixed, even if the tear string has been pulled substantially all the way to the right side of the tubular body.

Upon pulling of tear string 44, tear string 44 tears through two thicknesses of ply 20, in the gusset region, before encountering the perforation 42 in the upper step layers of plies 20, 22, 24.

When end 14 of bag 10 has been folded over and sealed, opening of the end of the bag is accomplished by pulling tear string 44 through extended portion 46 of ply 24 of lower step 34. A free end 48 of tear string 44 extends to the side of tubular body 1 2, for grasping. Perforation 42 preferably extends only a portion of the distance from the left-side edges of bag body 12, toward the middle of the width of the bag.

Figure 4:
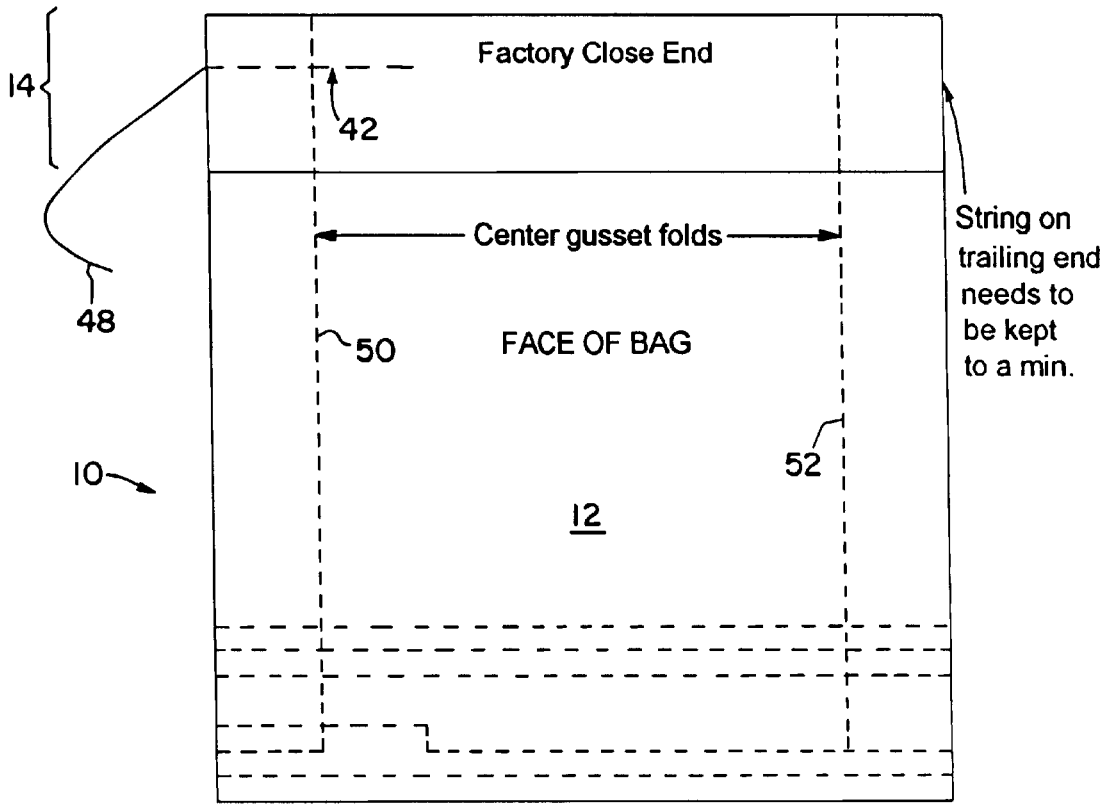
FIG. 4 is a face elevation of a bag with the manufacturer's end sealed, according to the embodiment of FIGS. 1–3.
Figure 6:
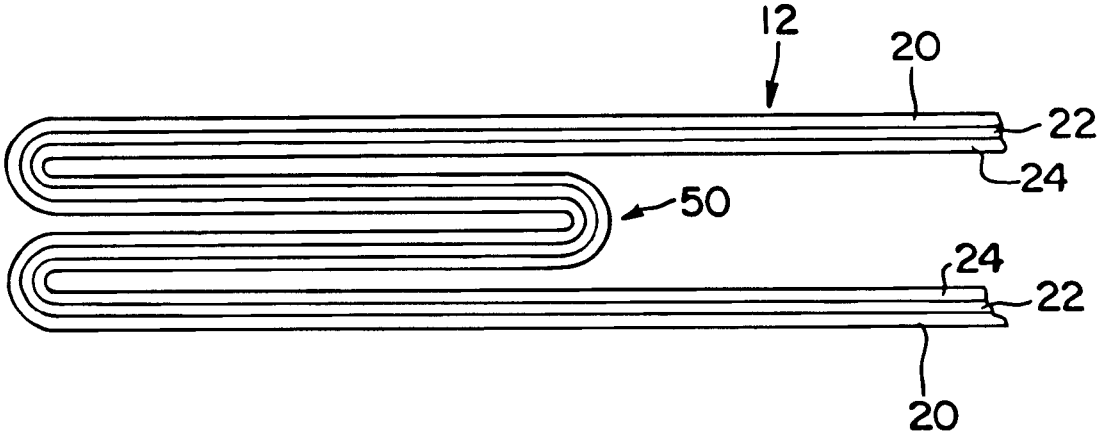
FIG. 6 is a sectional plan view of the bag of FIGS. 1–5, taken along lines 6—6 of FIG. 1.

FIG. 4 is an elevation of bag 10, shown with end 14 folded over and sealed. In a preferred embodiment of the invention, the positioning of string 44 and perforation 42 will be such that they will be preferably approximately ⅜ inch of the fold, although this distance may be varied, depending upon the requirements of a particular application. The inwardly tucked folds 50, 52 of the side gussets are shown by the broken lines, in both FIGS. 1 and 4. The layers of bag 10 below the level of mouth 16, are shown in FIG. 6, wherein the inward fold 50 of the left-side gusset, as seen in FIG. 1, is also indicated.

Figure 5:
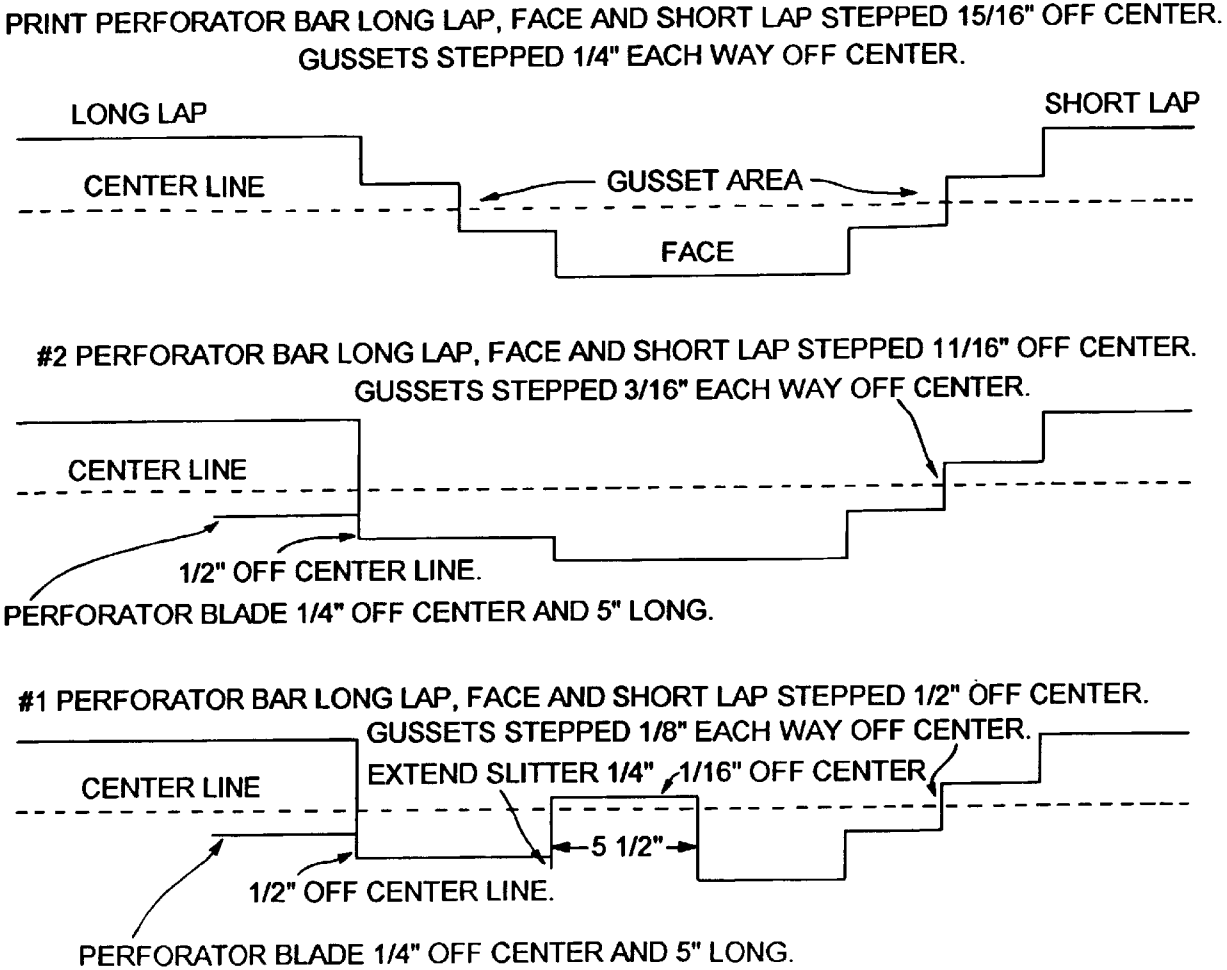
FIG. 5 illustrates the cut pattern for forming the upper and lower steps of the bag according to the embodiment of FIGS. 1–4.

FIG. 5 illustrates the patterns for the cuts for forming the upper and lower steps for the bag end 14 for the embodiment of the invention, according to FIGS. 1–3, which cutting specifications will be readily understood by one of ordinary skill in the art of paper bag manufacturing, having the present disclosure before them.

The opening mechanism of the present invention allows the consumer to create an opening at the side of the bag, which can be more easily controlled than prior art bag opening systems, in which the opening is typically formed toward the midpoint along the width of the bag end. In particular, prior art tear string opening mechanisms have usually created an opening at the center of the width of the bag, often leading to particularly ragged openings, that are awkward to manipulate.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. A bag apparatus for the containment of material, comprising:

a tubular body, fabricated from at least one ply of material;

the tubular body having a longitudinal axis;

the tubular body having a first end configured to form an elongated mouth opening;

the tubular body, when in a flattened condition, having first and second opposing sides adjacent the elongated mouth opening, and first and second side edges;

one of the opposing sides forming an upper step and the other of the opposing sides forming a lower step;

a fold line extending across the tubular body, transversely to the longitudinal axis, wherein the elongated mouth and portions of the lower step are disposed longitudinally between the upper step and the fold line;

a portion of the lower step, disposed adjacent the first side edge of the tubular body, extending further longitudinally away from the fold line, than other portions of the lower step;

a tear string member, disposed transversely across the first end of the tubular body, and extending across the longitudinally extending portion of the lower step, laterally inwardly from the first side edge of the tubular body toward the second side edge of the tubular body;

a line of weakness, disposed in at least one layer of the upper step of the tubular body, the line of weakness being substantially aligned with that portion of the tear string member that extends across the longitudinally extending portion of the lower step of the tubular body, and extending at least from the first side edge of the tubular body, laterally inwardly toward the second side edge of the tubular body.

2. The bag apparatus according to claim 1, further comprising the upper step being folded about the fold line, over and against the lower step and affixed thereto;

the tear string member and the line of weakness remaining in substantially alignment, with the tear string member being in longitudinally spaced position with respect to the fold line.

3. The bag apparatus according to claim 1, wherein the at least one ply of material is paper material.

4. The bag apparatus according to claim 1, wherein the tubular body is formed from three plies of material.

5. The bag apparatus according to claim 1, wherein the tubular body further comprises at least one inwardly folded gusset.

6. The bag apparatus according to claim 5, wherein the at least one inwardly folded gusset extends inwardly from the first side edge of the tubular body.

7. The bag apparatus according to claim 6, wherein the longitudinally extending portion of the lower step of the tubular body extends longitudinally beyond at least portions of the at least one inwardly folded gusset.

* * * * *